US005188563A

United States Patent [19]

Hanauer

[11] Patent Number: 5,188,563

[45] Date of Patent: Feb. 23, 1993

[54] MEDICAL FORM

[75] Inventor: Lisa E. Hanauer, Centerville, Ohio

[73] Assignee: Med-Pass, Incorporated, Dayton, Ohio

[21] Appl. No.: 924,178

[22] Filed: Aug. 3, 1992

[51] Int. Cl.[5] ..... B42D 15/00

[52] U.S. Cl. ..... 462/56; 283/900; 462/902

[58] Field of Search ..... 283/900; 462/56, 902

[56] References Cited

U.S. PATENT DOCUMENTS

| | | | |
|---|---|---|---|
| 2,035,768 | 3/1936 | Sherman et al. | 462/902 X |
| 3,222,086 | 12/1965 | Gosselin | 462/902 X |
| 3,625,547 | 12/1971 | Burke | 283/900 X |
| 3,960,634 | 6/1976 | Kempster | 283/900 X |
| 4,029,341 | 6/1977 | Neill et al. | 283/900 X |
| 4,221,404 | 9/1980 | Shuffstall | 283/900 X |
| 4,295,664 | 10/1981 | Cutting | 283/900 X |
| 4,932,682 | 6/1990 | Miller | 462/56 |
| 5,102,371 | 4/1992 | Hanauer | 462/56 |

FOREIGN PATENT DOCUMENTS

| | | | |
|---|---|---|---|
| 505438 | 9/1951 | Belgium | 283/900 |

OTHER PUBLICATIONS

Physician's Orders, MP 7503 POF/MAR Combo, Med-Pass, Inc.

Treatment Record, MP 3901, Med-Pass, Inc.

Physician's Orders/Medical Plan of Treatment, EPSI 218-R1/88, Forms Plus, Inc.

*Primary Examiner*—Paul A. Bell

*Attorney, Agent, or Firm*—Biebel & French

[57] ABSTRACT

A combination medical form includes a Physician's Orders Sheet, a Medication Administration Record and a Treatment Administration Record. The Medication Administration Record and the Treatment Administration Record feature non-overlapping columns of instruction blocks and a series of columns of record cells arranged in a space efficient manner.

7 Claims, 7 Drawing Sheets

MEDICAL FORM

BACKGROUND OF THE INVENTION

This invention relates to multiple medical forms and more particularly to medical forms which are especially useful in nursing homes and the like. Heretofore it has been customary to provide three separate forms for administering medical care to a nursing home patient. One of these forms has been a Physician's Orders Sheet for recordal of physician's orders. Secondly, there has been a Medication Administration Record upon which nurses have recorded the administration of prescribed medications together with notes of observations made in connection with the administration of the medication. The third form has been a Treatment Administration Record used by nurses to record the administration of prescribed treatments and to record observations relating to those treatments.

Recently combination forms have been introduced which combine a Physician's Orders Sheet with a Medication Administration Record. These combination forms employ patterned carbon paper transfer sheets or patterned carbonless copy sheets for transferring medication instructions from the Physician's Orders Sheet to the Medication Administration Record. The carbon patterns on the transfer sheets are arranged in such a manner as to prevent the transfer of markings onto the Medication Administration Record.

Somewhat more recently, combination forms have been introduced which combine the functions of all of the above three mentioned forms. However, these combination forms have been oversized and awkward to use due to conflicting demands for the same space on the form. Thus, there has been a need for an improved multiple part medical form which combines a Physician's Orders Sheet, a Medication Administration Record and a Treatment Administration Record in a convenient space-efficient manner.

SUMMARY OF THE INVENTION

This invention provides an improved multiple part medical form which combines a Physician's Orders Sheet, a Medication Administration Record and a Treatment Administration Record suitable for production in conventional loose-leaf notebook size. Patterned pressure-sensitive transfer means are employed to transfer physician's orders from a Physician's Orders Sheet to selective areas on a Medication Administration Record and a Treatment Administration Record. Customarily, administration records of both of the above types require a series of side-by-side cells arranged in vertical columns; one column for each calendar month. Space efficiency has been achieved by arranging the columns of administration record cells to flank the physician's instruction blocks on one of the two administration records. On the other administration record the physician's instruction blocks are positioned in the customary manner at the left-hand side of the form. For each form, however, the column of instruction blocks and the associated columns of record cells have an aggregate width which extends substantially the full width of the front face of the administration record form.

In the preferred embodiment, the columns of record cells in the Medication Administration Record remain contiguous, while the columns of record cells on the Treatment Administration Record are split into bimonthly groups flanking a medially positioned column of treatment instruction blocks. The rear faces of the Medication Administration Record and the Treatment Administration Record are printed to display a plurality of conventional data entry lines and instructions for recording administration notes on those lines.

DESCRIPTION OF THE PREFERRED EMBODIMENT

Figure 1:
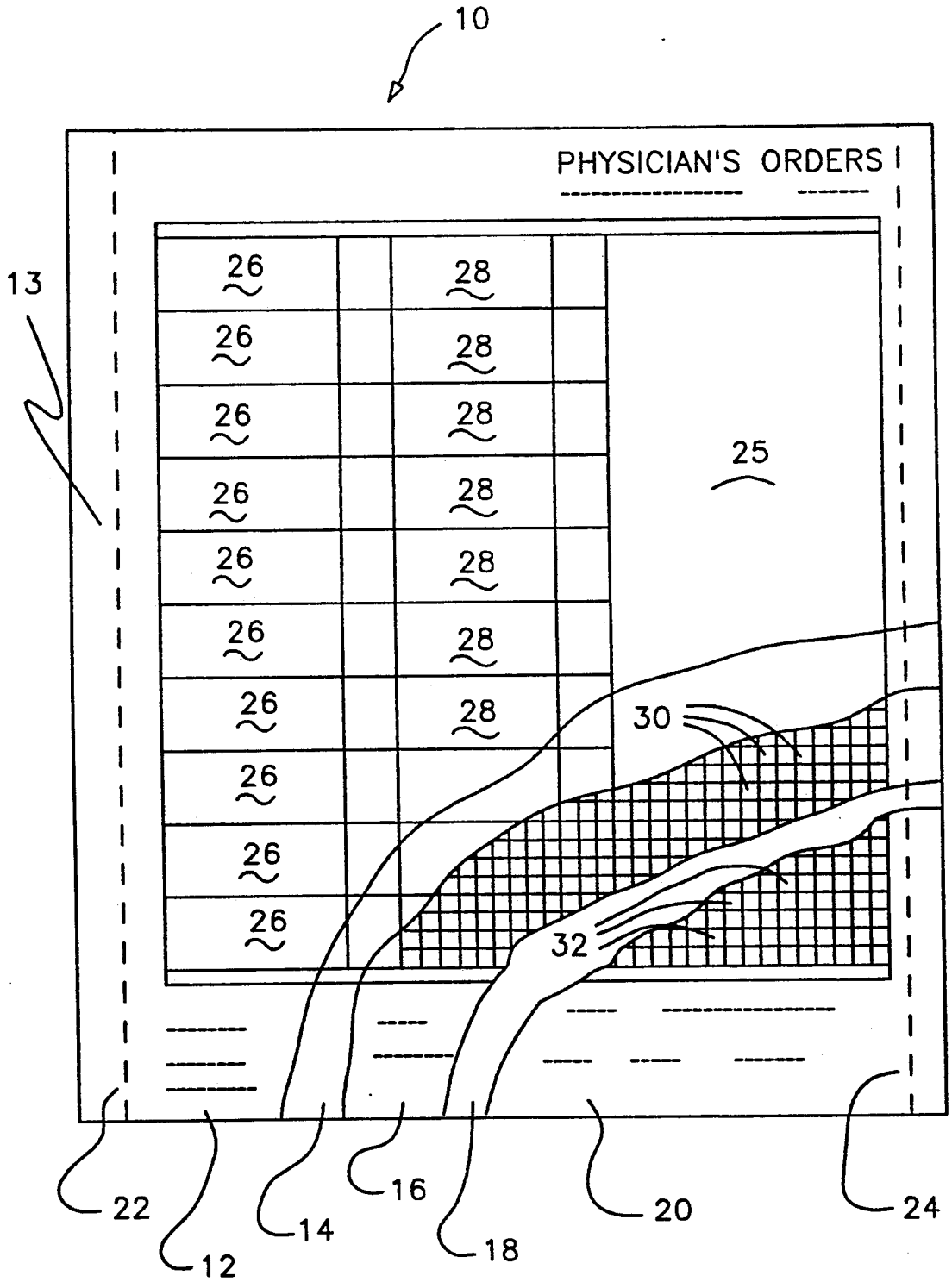
FIG. 1 is a schematic illustration of a combined medical form in accordance with the present invention.

A multiple part form 10 in accordance with the present invention is illustrated in FIG. 1 as comprising five overlaid sheets. The five sheets are printed and assembled in the conventional manner on a forms press. The forms may be produced in a continuous strip or as snap sets, marginally bound at the sides with vertically extending perforations 22,24. During use the form may be gripped alternatively at the top margin 11 or at the left side margin 13, as taught in Hanauer U.S. Pat. No. 5,102,371. If the form is gripped at the side margin 13, then it must be broken apart at the perforation line 24 prior to use. If it is gripped in the top marginal area 11, then it is broken apart at both of perforation lines 22 and 24.

The topmost sheet of form 10 is a Physician's Orders Sheet 12 upon which a physician makes typed, handwritten or computer printed entry of a medical plan of treatment. The plan includes medication instructions which are entered into a vertically arranged column of medication instruction blocks 26 and treatment instructions which are arranged into a vertically arranged column of treatment instruction blocks 28. Blocks 28 are arranged in horizontal alignment with blocks 26. Physician's Orders Sheet 12 also has an area 25 reserved for "other orders". The attending physician may write the above instructions on sheet 12 using a hard writing instrument, such as a ballpoint pen. The rear face of sheet 12 is entirely coated with pressure-sensitive microcapsules of the conventional type which rupture to produce a reactive dye upon being crushed by the force of the writing instrument.

Figure 4:
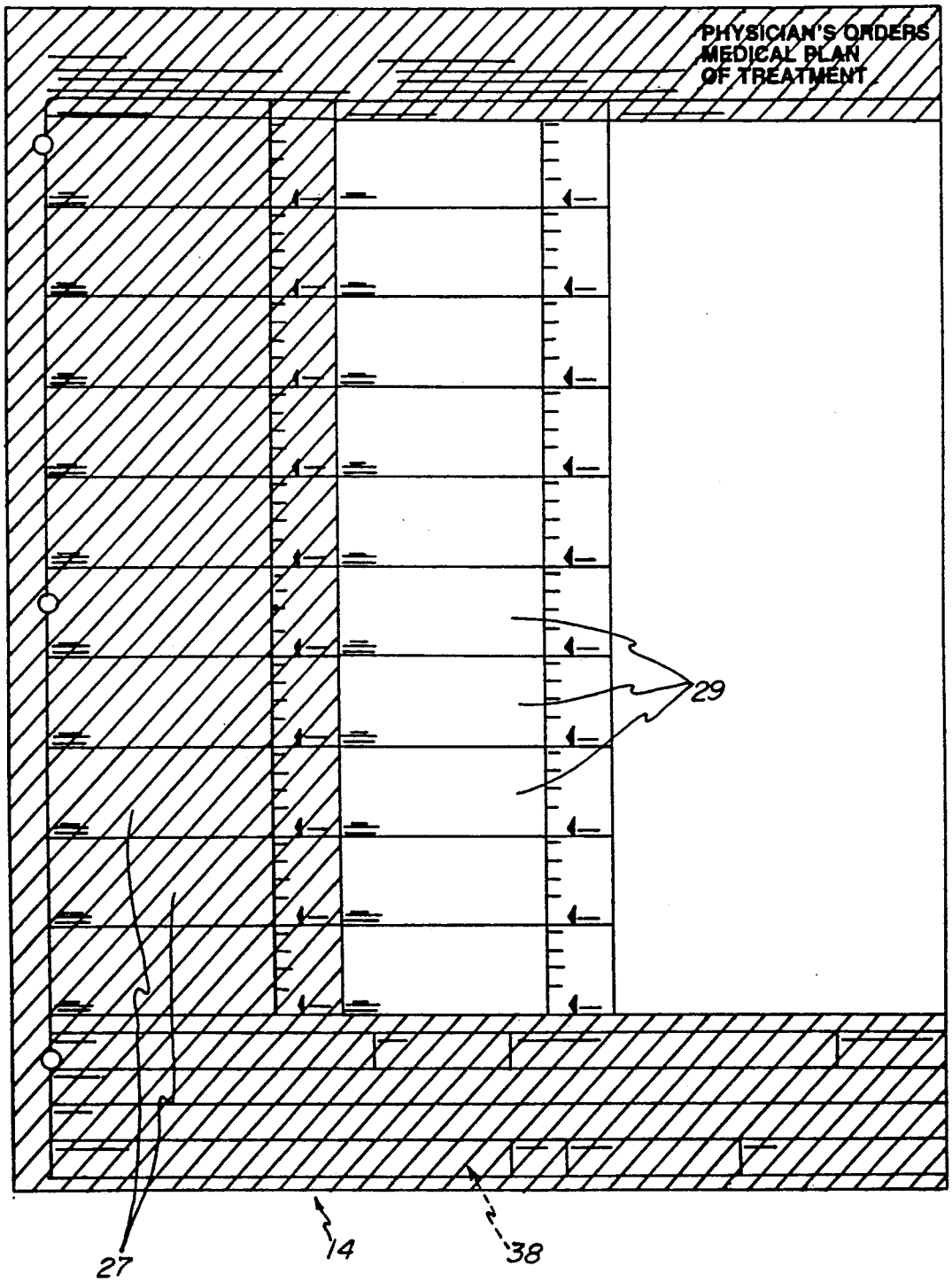
FIG. 4 is an illustration of a duplicate of a Physician's Order Sheet showing pressure-sensitive mark transfer areas.

Immediately below sheet 12 is a duplicate copy thereof denoted by the reference numeral 14 on FIG. 1. The front face of sheet 14 is covered with pressure-sensitive microcapsules containing a dye which is reactive with the dye carried by the microcapsules on the rear side of sheet 12. Thus, all of the physician's instructions written on sheet 12 are reproduced on sheet 14, thereby producing a conventional "carbonless copy". The front face of sheet 14 is preprinted with the same information as the front face of sheet 12. Thus it includes a vertically extending column of medication instruction blocks 27 and a vertically extending column of treatment instruction blocks 29 (FIG. 4). Blocks 27 and 29 are in registration with blocks 26 and 28 respectively of sheet 12.

The rear face of sheet 14 is coated with a pattern of pressure-sensitive microcapsules as generally illustrated by reference numeral 38 of FIG. 4. This pattern includes the lower area of the sheet which carries items such as the physician's name, patient's name, and other routine information. The pattern 38 also extends behind the row of medication instruction blocks 27.

A Medication Administration Record 16 is positioned immediately below sheet 14. The front face 41 (FIG. 2) of Medication Administration Record 16 is coated with a pattern of pressure-sensitive microcapsules (not illustrated) matching the pattern 38 of sheet 14. Again, the two types of capsules are reactive, so that markings within the area 38 of sheet 14 are transferred to the front face of Medication Administration Record 16. For receiving these markings, Medication Administration Record 16 has a series of medication instruction blocks 34 arranged in a vertically extending column in registration with the like-named blocks 26,27 of sheets 12,14. One of the blocks 34 is illustrated in detail in FIG. 2.

The printed area of front face 41 has a width W which extends substantially the full width of the face. The column of medication instruction blocks 34 has a width A, leaving a width B which is filled by a series of columns of medication record cells 30, one column for each day of a calendar month. Medication record cells 30 have a width X, so that B equals 31 * X. The above-mentioned pattern of microcapsules does not permit the transfer of any markings into the area B. That reserves the area for data entries by the staff nurse.

Figure 6:
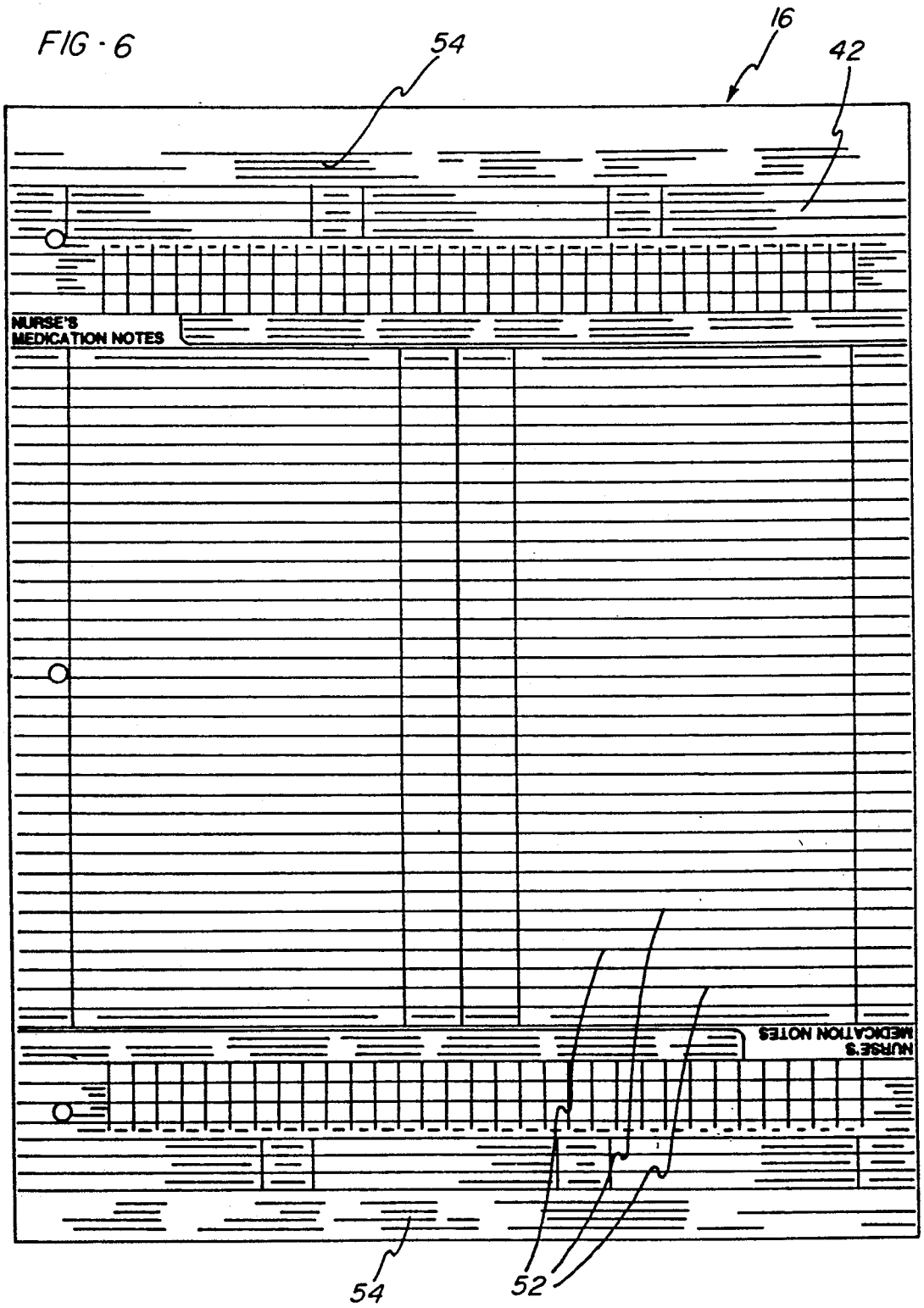
FIG. 6 is an illustration of the rear face of a Medication Administration Record.

The rear face 42 of Medication Administration Record 16 may appear as generally illustrated in FIG. 6. Rear face 42 is printed to display a plurality of data entry lines 52 and instructions 54 for recording medication administration notes on those data lines. Preferably, those instructions are printed reversibly at the top and bottom of rear face 42 to accommodate alternative side or top binding, as discussed above. Reference is made to U.S. Pat. No. 5,102,371 for further details.

Figure 5:
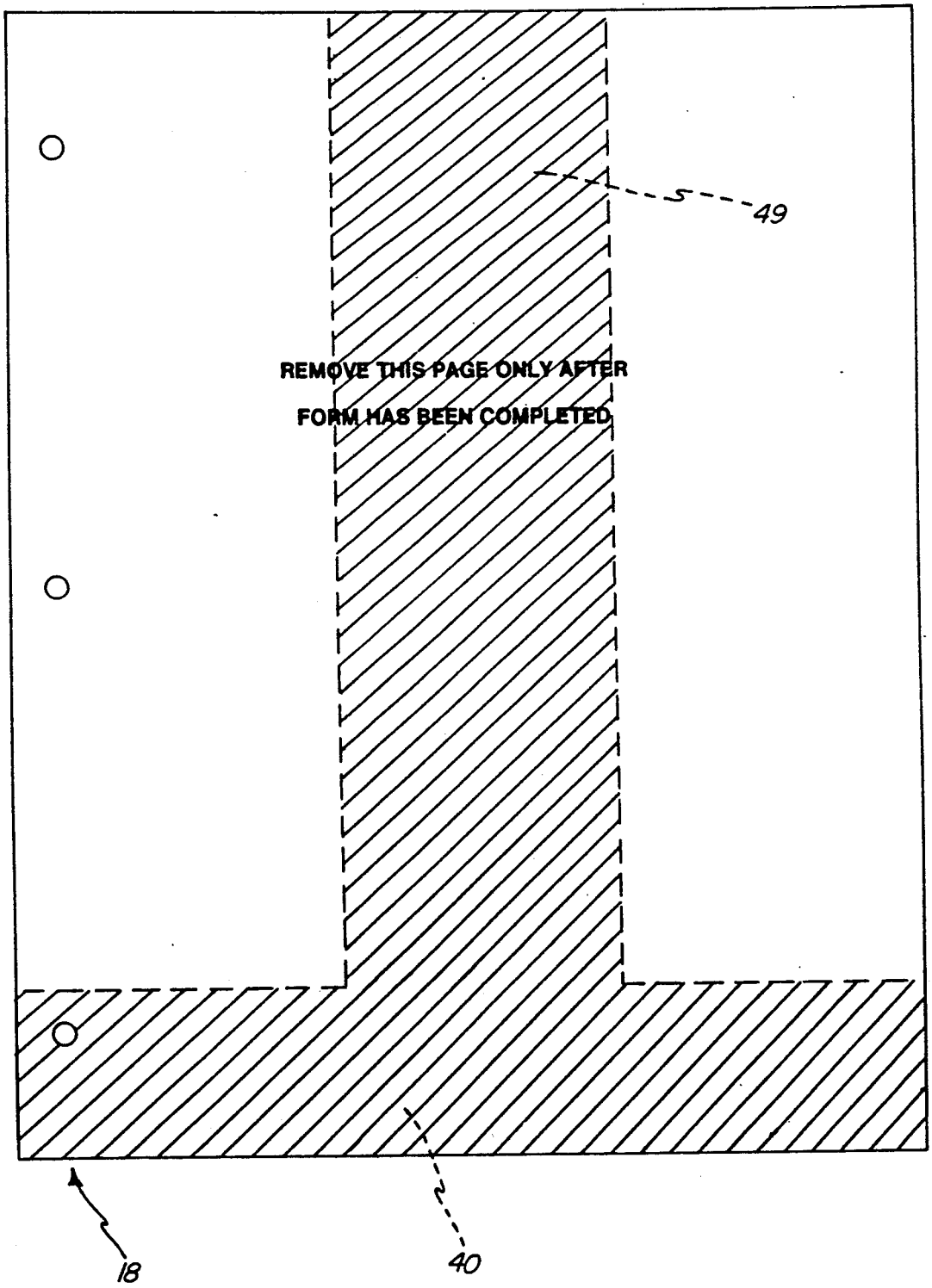
FIG. 5 is an illustration of a transfer sheet showing a pattern of pressure-sensitive mark transfer areas.

The rear face 42 of Medication Administration Record 16 is in face-to-face contact with the front face a transfer sheet 18 as illustrated in FIG. 5. There is no pressure transfer material between these two faces. However, the rear face of transfer sheet 18 is coated with a pattern of pressure-sensitive microcapsules within an area as denoted generally by the reference numeral 40. The area 40 has an upper portion 49 which is in registration with the columns of treatment instruction blocks 28 of sheet 12 and 29 of sheet 14. The area 49 is in face-to-face contact with a similarly shaped pattern of microcapsules (not illustrated) on the front face 51 (FIG. 3) of an underlying Treatment Administration Record 20. This permits pressure induced transfer of markings from treatment instruction blocks 28, 29 of sheets 12,14 into a vertically extending column of treatment instruction blocks 36 on the front face of record 20. Due to the pattern shape of the microcapsules on the front face of Medication Administration Record 16, the treatment instructions in blocks 28,29 pass marklessly through the record 16 and markingly into blocks 36.

Figure 3:
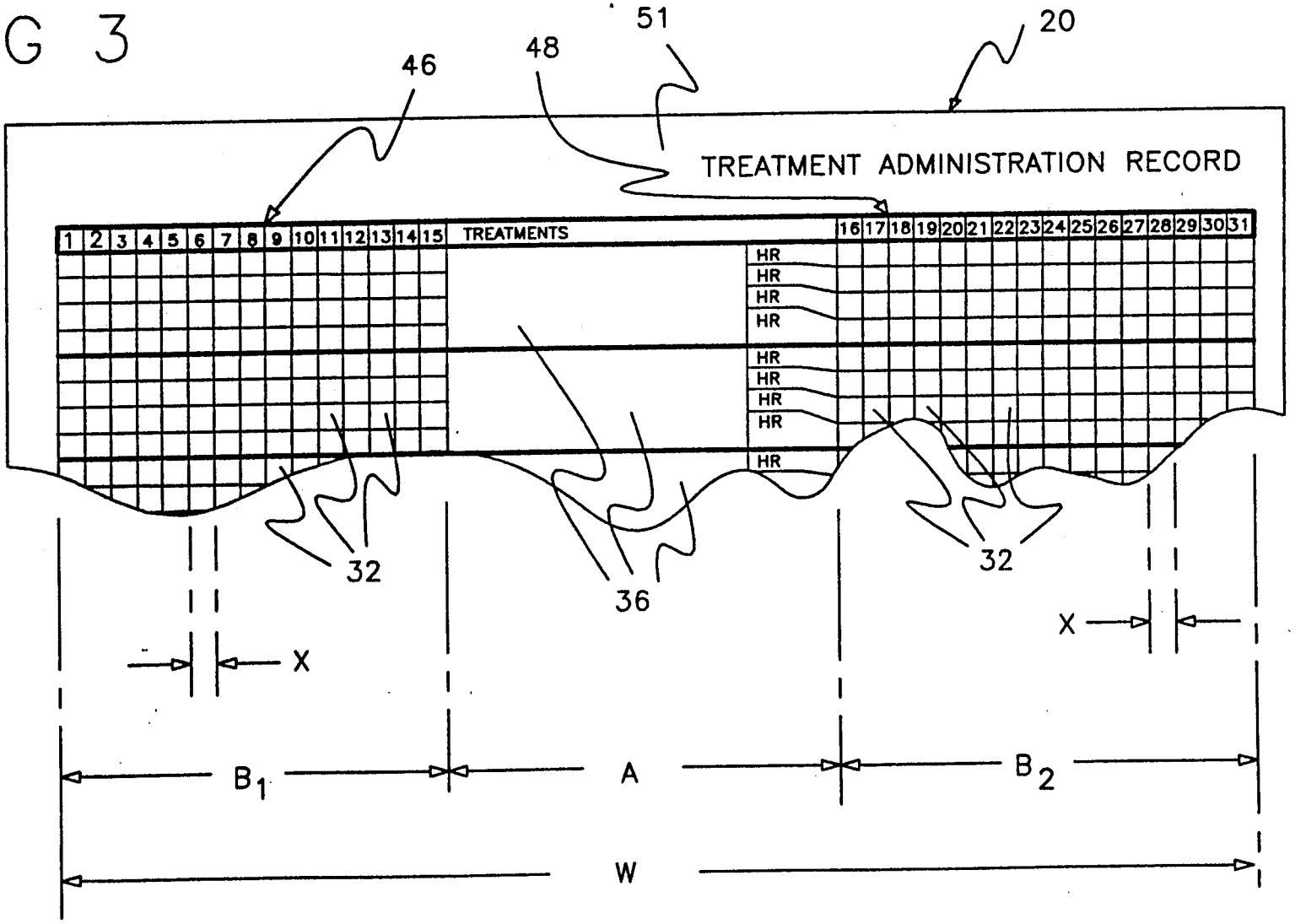
FIG. 3 is a schematic illustration of the preprinted information on the front face of a Treatment Administration Record.

As shown in FIG. 3, the front face 51 of Treatment Administration Record 20 is printed across an area of width W. It will be noted that this width is the same as the width of the printed area of front face 41 of Medication Administration Record 16. However, treatment instruction blocks 36 are printed medially of their associated administration record and are flanked both left and right by columns of treatment record cells 32 arranged to define a left bank 46 of width $B_1$ and a right bank 48 of width $B_2$. Treatment record cells 32 have a width X matching the width X of medication record cells 30. Preferably there are 31 columns of treatment record cells 32 so, they have an aggregate width B.

Treatment instruction blocks 36 have a width A which is the same as the width of medication instruction blocks 34. Therefore the column of instruction blocks 36 and the columns of record cells 32 have an aggregate width which extends substantially the full width of front face 51 of the Treatment Administration Record 80. By thusly splitting the columns of cells 32, the invention makes it possible to assemble the record 20 in registration below the record 16 without loss of space on the front face of either record.

Figure 2:
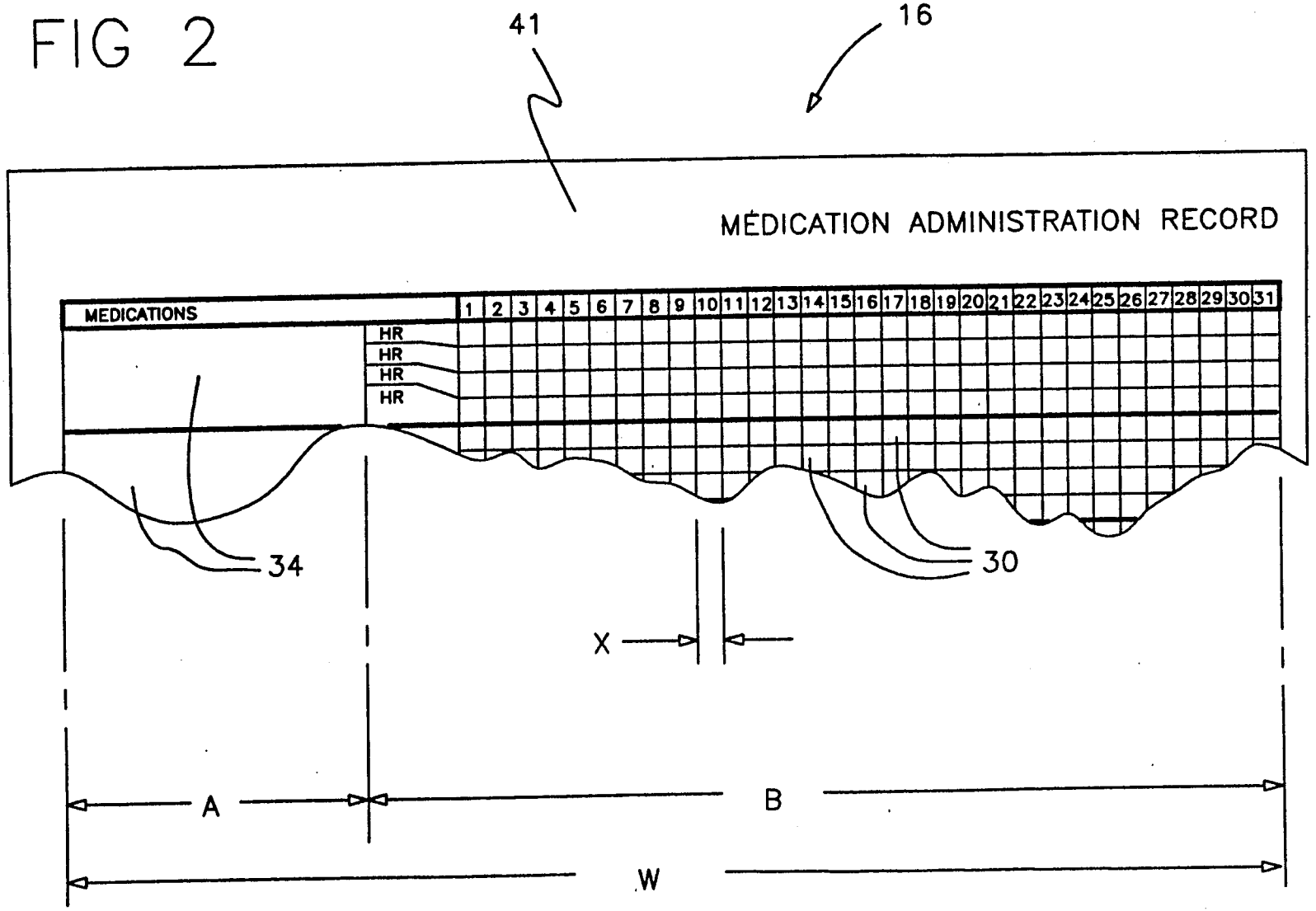
FIG. 2 is a schematic illustration of the preprinted information on the front face of a Medication Administration Record.

It is apparent that the arrangement of the information on records 16 and 20 could be interchanged, so that Treatment Administration Record 20 would appear as generally illustrated in FIG. 2, and Medication Administration Record 16 would appear as generally illustrated in FIG. 3. However, the above-described arrangement is preferred, because the relatively more frequent medication data entries can take advantage of the convenience of full month left-to-right reading. In either event the column of medication instruction blocks and the column of treatment instruction blocks are placed in non-overlapping areas of the form, and the columns of record cells are horizontally placed to occupy areas which are non-occupied by their associated instruction blocks.

Figure 7:
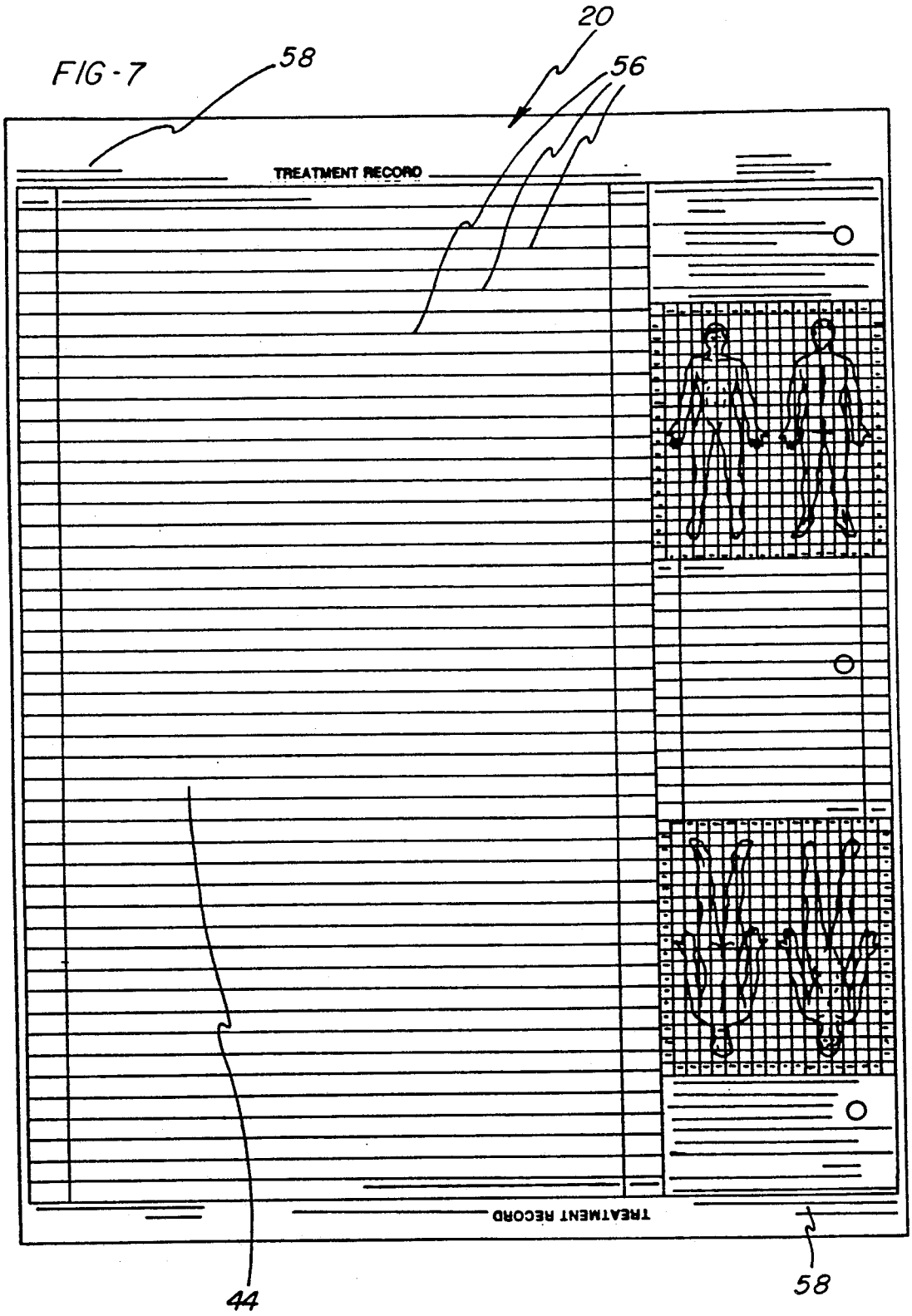
FIG. 7 is an illustration of the rear face of a Treatment Administration Record.

The rear face 44 of Treatment Administration Record 20 is illustrated generally in FIG. 7. The face 44 is printed to display a plurality of data entry lines 56 and instructions 58 for recording treatment administration notes thereon. Again, the instructions are reversibly printed at the top and bottom in accordance with U.S. Pat. No. 5,102,371.

While the products herein described constitute a preferred embodiment of the invention, it is to be understood that the invention is not limited to these precise products, and that changes may be made therein without departing from the scope of the invention which is defined in the appended claims.

What is claimed is:

1. A medical form comprising a Physician's Orders Sheet, a Medication Administration Record, a Treatment Administration Record and pressure transfer means, all releasibly bound in mutual registration;

said Physician's Orders Sheet being arranged on top of both of said records for direct entry of physician's orders and having a front face which is printed to display a vertically extending column of medication instruction blocks for insertion of medication orders and a vertically extending column of treatment instruction blocks for insertion of treatment orders;

said Medication Administration Record having a front face which is printed to display a vertically extending column of medication instruction blocks in registration with the like-named blocks on said Physician's Orders Sheet and a series of vertically extending columns of medication record cells, said columns of medication record cells and said column of medication instruction blocks having an aggregate horizontal width which is substantially equal to the full width of the front face of said Medication Administration Record;

said Treatment Administration Record having a front face which is printed to display a vertically extending column of treatment instruction blocks in registration with the like-named blocks on said Physician's Orders Sheet and a series of vertically extending columns of treatment record cells, said columns of treatment record cells and said column of treatment instruction blocks having an aggregate width which is substantially equal to the full width of the front face of said Treatment Administration Record;

said columns of medication instruction blocks and said column of treatment instruction blocks being placed in non-overlapping areas of said form, and said columns of record cells being horizontally placed to occupy areas which are non-occupied by their associated instruction blocks;

said pressure transfer means being arranged for pressure actuated transfer of physician's orders from the medication instruction blocks on said Physician's Orders Sheet to the like-named blocks on said Medication Administration Record and pressure actuated transfer of physician's orders from the treatment instruction blocks on said Physician's Orders Sheet to the like-named blocks on said Treatment Administration Record; and said pressure transfer means being further arranged to avoid pressure actuated transfer of markings onto any of said columns of medication record cells or any of said columns of treatment record cells.

2. A medical form according to claim 1 wherein said columns of medication instruction blocks are arranged toward the left of said form; said columns of medication record cells are arranged to the right of said columns of medication record blocks; said columns of treatment instruction blocks are arranged medially of said of said form; and said columns of treatment record cells are arranged in two banks flanking said treatment instruction blocks to the left and to the right.

3. A medical form according to claim 2; said Medication Administration Record having a rear face which is printed to display a plurality of data entry lines and instructions for recording medication administration notes thereon; and said Treatment Instruction Record having a rear face which is printed to display a second plurality of data entry lines and instructions for recording treatment administration notes thereon.

4. A medical form according to claim 3, said pressure transfer means comprising reactive dyes carried within pressure responsive microcapsules.

5. A medical form comprising a Physician's Orders Sheet, a Medication Administration Record, a Treatment Administration Record and pressure transfer means, all releasibly bound in mutual registration;

said Physician's Orders Sheet being arranged on top of both of said records for direct entry of a physician's orders and having a front face which is printed to display a vertically extending column of medication instruction blocks for insertion of medication orders and a vertically extending column of treatment instruction blocks for insertion of treatment orders;

said Medication Administration Record having a front face which is printed to display a vertically extending column of medication instruction blocks in registration with the like-named blocks on said Physician's Orders Sheet and a series of vertically extending columns of medication record cells, said columns of medication record cells and said column of medication instruction blocks having an aggregate horizontal width which is substantially equal to the full width of the front face of said Medication Administration Record;

said Treatment Administration Record having a front face which is printed to display a vertically extending column of treatment instruction blocks in registration with the like-named blocks on said Physician's Orders Sheet and a series of vertically extending columns of treatment record cells, said columns of treatment record cells and said column of treatment instruction blocks having an aggregate width which is substantially equal to the full width of the front face of said Treatment Administration Record;

one of said columns of instruction blocks being situated medially of its associated administration record and being flanked on both sides by banks of record cells;

the other said column of instruction blocks being situated to the left side of its associated administration record and to the left of its associated columns of record cells;

said pressure transfer means being arranged for pressure actuated transfer of physician's orders from the medication instruction blocks on said Physician's Orders Sheet to the like-named blocks on said Medication Administration Record and pressure actuated transfer of physician's orders from the treatment instruction blocks on said Physician's Orders Sheet to the like-named blocks on said Treatment Administration Record; and said pressure transfer means being further arranged to avoid pressure actuated transfer of markings onto any of said columns of medication record cells or any of said columns of treatment record cells.

6. A medical form according to claim 5, said pressure transfer means comprising means for transferring selected instructions from said Physician's Orders Sheet to the front face of the uppermost of said administration records and other selected instructions marklessly through said uppermost administration record and markingly upon the front face of the administration record situated therebelow.

7. A medical form comprising an original copy of a Physician's Orders Sheet, a duplicate copy of said Physician's Orders Sheet in registration below said original copy, a Medication Administration Record in registration below said duplicate copy, a patterned pressure transfer sheet in registration below said Medication Administration Record and a Treatment Administration Record in registration below said pressure transfer sheet;

said copies of said Physician's Orders Sheet having front faces which are printed to display mutually registered and vertically extending columns of medication instruction blocks for insertion of medication orders and mutually registered, vertically extending columns of treatment instruction blocks for insertion of treatment orders;

said Medication Administration Record having a front face which is printed to display a vertically extending column of medication instruction blocks in registration with the like-named blocks on said copies of said Physician's Orders Sheet and a series of vertically extending columns of medication record cells, said columns of medication record cells and said column of medication instruction blocks having an aggregate horizontal width which is substantially equal to the full width of the front face of said Medication Administration Record;

said Treatment Administration Record having a front face which is printed to display a vertically extending column of treatment instruction blocks in registration with the like-named blocks on said copies of said Physician's Orders Sheet and a series of vertically extending columns of treatment record cells, said columns of treatment record cells and said column of treatment instruction blocks having an aggregate width which is substantially equal to the full width of the front face of said Treatment Administration Record;

said column of treatment instruction blocks being situated medially of said Treatment Administration Record and being flanked on both sides by banks of said treatment record cells;

said column of medication instruction blocks being situated to the left side of said Medication Administration Record and to the left of said medication record cells;

said pressure transfer sheet being arranged for pressure actuated transfer of physician's orders from the treatment instruction blocks on said copies of said Physician's Orders Sheet, marklessly through said Medication Administration Record and markingly into the like-named blocks on said Treatment Administration Record; and pressure actuated means being provided for transferring physician's orders from the medication instruction blocks on said copies of said Physician's Orders Sheet to the like-named blocks on said Medication Administration Record.

* * * * *